US008735039B2

(12) United States Patent
Hidaka

(10) Patent No.: US 8,735,039 B2
(45) Date of Patent: May 27, 2014

(54) TONER FOR ELECTROSTATIC IMAGE DEVELOPMENT

(71) Applicant: Kao Corporation, Chuo-ku (JP)

(72) Inventor: Yasuhiro Hidaka, Wakayama (JP)

(73) Assignee: Kao Corporation, Chuo-ku (JP)

( * ) Notice: Subject to any disclaimer, the term of this patent is extended or adjusted under 35 U.S.C. 154(b) by 28 days.

(21) Appl. No.: 13/672,964

(22) Filed: Nov. 9, 2012

(65) Prior Publication Data

US 2013/0130167 A1 May 23, 2013

(30) Foreign Application Priority Data

Nov. 18, 2011 (JP) ..... 2011-252949

(51) Int. Cl.
*G03G 9/087* (2006.01)

(52) U.S. Cl.
USPC ..... 430/109.4

(58) Field of Classification Search
USPC ..... 430/109.4
See application file for complete search history.

(56) References Cited

U.S. PATENT DOCUMENTS

| | | | |
|---|---|---|---|
| 6,383,705 | B2 | 5/2002 | Aoki et al. |
| 6,821,698 | B2 | 11/2004 | Sawada et al. |
| 6,890,695 | B2 | 5/2005 | Shirai et al. |
| 7,163,774 | B2 | 1/2007 | Shiraishi et al. |
| 7,390,605 | B2 | 6/2008 | Shirai |
| 2001/0018157 | A1 | 8/2001 | Aoki et al. |
| 2003/0039910 | A1 | 2/2003 | Shirai et al. |
| 2003/0129518 | A1 | 7/2003 | Sawada et al. |
| 2004/0157147 | A1 | 8/2004 | Shiraishi et al. |
| 2005/0227157 | A1 | 10/2005 | Shirai |
| 2010/0055595 | A1* | 3/2010 | Shirai et al. ..... 430/109.4 |
| 2011/0212395 | A1* | 9/2011 | Aoki et al. ..... 430/108.1 |

FOREIGN PATENT DOCUMENTS

| | | | |
|---|---|---|---|
| JP | 11-249339 | A | 9/1999 |
| JP | 2001-222138 | A | 8/2001 |
| JP | 2002-287426 | A | 10/2002 |
| JP | 2003-167384 | A | 6/2003 |
| JP | 2004-245887 | A | 9/2004 |
| JP | 2005-300867 | A | 10/2005 |
| JP | 2012-128071 | A | 7/2012 |

* cited by examiner

*Primary Examiner* — Hoa V Le
(74) *Attorney, Agent, or Firm* — Oblon, Spivak, McClelland, Maier & Neustadt, L.L.P.

(57) ABSTRACT

A toner for electrostatic image development containing at least a resin binder, the resin binder being composed of a crystalline resin and an amorphous resin, wherein the crystalline resin contains a crystalline polyester obtained by polycondensing an alcohol component containing an aliphatic diol having 2 to 10 carbon atoms and a carboxylic acid component containing an aromatic dicarboxylic acid compound and an aromatic tricarboxylic or higher polycarboxylic acid compound, wherein the crystalline polyester has a weight-average molecular weight of from 20,000 to 150,000, and wherein the crystalline resin and the amorphous resin are in a weight ratio, i.e. crystalline resin/amorphous resin, of from 55/45 to 95/5. The toner for electrostatic image development of the present invention can be suitably used in, for example, the development or the like of latent image formed in electrophotography, an electrostatic recording method, an electrostatic printing method, or the like.

19 Claims, No Drawings

TONER FOR ELECTROSTATIC IMAGE DEVELOPMENT

FIELD OF THE INVENTION

The present invention relates to a toner for electrostatic image development usable in developing latent images formed in, for example, electrophotography, an electrostatic recording method, an electrostatic printing method, or the like.

BACKGROUND OF THE INVENTION

With the demands in speeding-up, miniaturization or the like in the recent years, a toner capable of fixing at an even lower temperature is in demand. In order to meet this demand, toners in which a crystalline resin and an amorphous resin are used as resin binders are proposed.

For example, proposals for such toners include:

a toner containing a crystalline polyester having a softening point of from 85° to 150° C., obtained by polycondensing an alcohol component containing a diol having 2 to 6 carbon atoms in an amount of 80% by mol or more and a carboxylic acid component containing fumaric acid in an amount of 80% by mol or more, and an amorphous polyester, wherein a crystalline polyester/amorphous polyester weight ratio is from 1/99 to 50/50 (see Japanese Patent Laid-Open No. 2001-222138);

a toner containing a resin binder containing a crystalline polyester and an amorphous polyester, wherein the crystalline polyester is contained in an amount of from 1 to 40% by weight of the resin binder, and wherein 90% of dispersed domains of the crystalline polyester have a diameter of from 0.1 to 2 μm (Japanese Patent Laid-Open No. 2002-287426); and a toner containing a crystalline polyester having a softening point of from 80° to 130° C., obtained by polycondensing an alcohol component containing an aliphatic diol having 2 to 8 carbon atoms in an amount of 70% by mol or more, and a carboxylic acid component containing an aromatic dicarboxylic acid compound in an amount of 70% by mol or more, and an amorphous polyester obtained by polycondensing an alcohol component containing an alkylene oxide adduct of bisphenol A in an amount of 70% by mol or more, and a carboxylic acid component, wherein a crystalline polyester/amorphous polyester weight ratio is from 5/95 to 50/50 (see Japanese Patent Laid-Open No. 2005-300867).

In addition, proposals are made on a toner binder comprising 0.5 to 50% by weight of a crystalline polyester having a melting point of from 50° to 120° C., a melt viscosity at 150° C. of from 5 to 1,000 centi-Poises, a hydroxyl value of 5 or less, and an acid value of 20 or less, and 50 to 99.5% by weight of a resin binder having a glass transition temperature of from 50° to 100° C. (see, Japanese Patent Laid-Open No. Hei-11-249339), and a toner containing a crystalline polyester, an amorphous polyester, a black metal material having a saturation magnetization of 50 emu/g or less (see, Japanese Patent Laid-Open No. 2004-245887).

SUMMARY OF THE INVENTION

The present invention relates to a toner for electrostatic image development containing at least a resin binder, the resin binder being composed of a crystalline resin and an amorphous resin, wherein the crystalline resin contains a crystalline polyester obtained by polycondensing an alcohol component containing an aliphatic diol having 2 to 10 carbon atoms and a carboxylic acid component containing an aromatic dicarboxylic acid compound and an aromatic tricarboxylic or higher polycarboxylic acid compound, wherein the crystalline polyester has a weight-average molecular weight of from 20,000 to 150,000, and wherein the crystalline resin and the amorphous resin are in a weight ratio, i.e. crystalline resin/amorphous resin, of from 55/45 to 95/5.

DETAILED DESCRIPTION OF THE INVENTION

While a toner in which a crystalline resin and an amorphous resin are used as described above has improvement in low-temperature fixing ability, a resin strength thereof is likely to be lowered. As a result, if a toner is exposed to even more mechanical or thermal stress with the speeding up and miniaturization of the machines, the toner is likely to cause some disadvantages such as high-temperature offset resistance, in other words, highest fixing temperature, and storage stability are lowered, and disadvantages regarding the lowering of durability, such as deposition on a developer blade or uneven lines formed on the developer roller. These disadvantages become serious issues when the toner is used in a nonmagnetic monocomponent developing device in which a toner is charged by frictions with a developer blade, or in an oil-less nonmagnetic monocomponent developing device in which a releasing agent is needed to be contained in a larger amount in the toner.

Further, with the demands of the speeding up, miniaturization and the like of the recent year, a toner with an even more improvement in low-temperature fixing ability is earnestly desired.

While the toner has improved low-temperature fixing ability if a content of a crystalline polyester is increased, there are some disadvantages such as high-temperature offset resistance, storage stability and the like are lowered, as disclosed in, for example, Japanese Patent Laid-Open No. 2001-222138, Comparative Example 1; Japanese Patent Laid-Open No. 2002-287426, Comparative Example 4; Japanese Patent Laid-Open No. 2005-300867, Comparative Example 6; Japanese Patent Laid-Open No. Hei-11-249339, Comparative Example 3.

The present invention relates to a toner for electrostatic image development having excellent low-temperature fixing ability and high-temperature offset resistance, a wide fixable region, and excellent storage stability, and suppression of formation of uneven lines on a developer roller.

The toner for electrostatic image development of the present invention exhibits some excellent effects of having excellent low-temperature fixing ability and high-temperature offset resistance, a wide fixable region, and excellent storage stability, and suppression of uneven lines on a developer roller. Further, the toner for electrostatic image development of the present invention exhibits excellent effects even when the toner is used in a full-color toner for a nonmagnetic monocomponent developing device, especially a full-color toner for an oil-less nonmagnetic monocomponent developing device in which a releasing agent is need to be contained in a larger amount in the toner.

These and other advantages of the present invention will be apparent from the following description.

The toner of the present invention is a toner for electrostatic image development which has the feature in that the toner contains a resin binder, the resin binder being composed of a crystalline resin and an amorphous resin, wherein the crystalline resin contains a crystalline polyester obtained by polycondensing an alcohol component containing an aliphatic diol having 2 to 10 carbon atoms and a carboxylic acid component containing an aromatic dicarboxylic acid compound and an aromatic tricarboxylic or higher polycarboxylic acid compound, wherein the crystalline polyester has a weight-average molecular weight of from 20,000 to 150,000, and wherein the crystalline resin and the amorphous resin are in a weight ratio, i.e. crystalline resin/amorphous resin, of from 55/45 to 95/5, whereby the toner has excellent low-temperature fixing ability and high-temperature offset resistance, a wide fixable region, and excellent storage stability, and suppression of formation of uneven lines on a developer roller.

The reasons why the effects as described above are exhibited are not fully elucidated, and it is considered to be as follows.

Since a crystalline polyester is contained in a larger amount in a resin binder, low-temperature fixing ability can be improved. However, in conventional crystalline resins, a part of a crystalline resin is amorphized by making the crystalline resin compatible with the amorphous resin, thereby having some disadvantages that high-temperature offset resistance and storage stability are markedly worsened.

However, in the present invention, an aromatic dicarboxylic acid compound and an aromatic tricarboxylic or higher polycarboxylic acid compound are used as a carboxylic acid component for a crystalline polyester, and a crystalline polyester having a weight-average molecular weight larger than a conventional crystalline polyester and in a particular range is used, and a content of the crystalline resin is made larger, in other words, a content of an amorphous resin is made smaller, so that amorphization of a part of a crystalline resin caused by making the crystalline resin compatible with the amorphous resin can be suppressed, so that it is considered that improvement in low-temperature fixing ability and improvements in high-temperature offset resistance, storage stability and durability can be both satisfied.

[Resin Binder]

In the present invention, the resin binder is composed of a crystalline resin and an amorphous resin, from the viewpoint of improving low-temperature fixing ability, high-temperature offset resistance and storage stability of the toner, and suppressing formation of uneven lines on a developer roller. The resin binder contains a crystalline polyester obtained by polycondensing an alcohol component containing an aliphatic diol having 2 to 10 carbon atoms and a carboxylic acid component containing an aromatic dicarboxylic acid compound and an aromatic tricarboxylic or higher polycarboxylic acid compound.

It is preferable that the resin binder contains a crystalline polyester as a main component, from the viewpoint of improving low-temperature fixing ability, high-temperature offset resistance and storage stability of the toner, and suppressing formation of uneven lines on a developer roller.

Here, the crystallinity of the resin is expressed by a crystallinity index defined by a value of a ratio of a softening point to a temperature of maximum endothermic peak determined by a scanning differential calorimeter, i.e. softening point/temperature of maximum endothermic peak. The crystalline resin is a resin having a crystallinity index of from 0.6 to 1.4, preferably from 0.7 to 1.2, and more preferably from 0.9 to 1.2, and the amorphous resin is a resin having a crystallinity index exceeding 1.4 or less than 0.6. The crystallinity of the resin can be adjusted by the kinds of the raw material monomers, a ratio thereof, production conditions, e.g., reaction temperature, reaction time, cooling rate, and the like. Here, the temperature of maximum endothermic peak refers to a temperature of the peak on the highest temperature side among endothermic peaks observed. When a difference between the temperature of maximum endothermic peak and the softening point is within 20° C., the temperature of maximum endothermic peak is defined as a melting point. When the difference between the temperature of maximum endothermic peak and the softening point exceeds 20° C., the peak is a peak temperature ascribed to a glass transition.

In the present invention, the alcohol component of the crystalline polyester contains an aliphatic diol having 2 to 10 carbon atoms, preferably 4 to 8 carbon atoms, and more preferably 4 to 6 carbon atoms, from the viewpoint of enhancement of crystallinity of the polyester and improvement in low-temperature fixing ability.

The aliphatic diol having 2 to 10 carbon atoms includes α,ω-linear alkanediols such as ethylene glycol, 1,3-propylene glycol, 1,4-butanediol, 1,5-pentanediol, 1,6-hexanediol, 1,7-heptanediol, 1,8-octanediol, 1,9-nonanediol, and 1,10-decanediol, 1,2-propylene glycol, neopentyl glycol, 1,4-butenediol, and the like. The α,ω-linear alkanediol is preferred, 1,4-butanediol and 1,6-hexanediol are more preferred, from the viewpoint of enhancement of crystallinity of the polyester and improvement in low-temperature fixing ability.

The aliphatic diol having 2 to 10 carbon atoms is contained in an amount of preferably 70% by mol or more, more preferably 80% by mol or more, even more preferably 90% by mol or more, and still even more preferably substantially 100% by mol of the alcohol component, from the viewpoint of enhancement of crystallinity of the polyester and improvement in low-temperature fixing ability. A proportion of one kind of the aliphatic diol having 2 to 10 carbon atoms occupying the alcohol component is preferably 50% by mol or more, and more preferably from 60 to 80% by mol.

The alcohol component may contain a polyhydric alcohol component other than the aliphatic diol having 2 to 10 carbon atoms, and other polyhydric alcohol component includes aromatic diols such as an alkylene oxide adduct of bisphenol A represented by the formula (I):

(I)

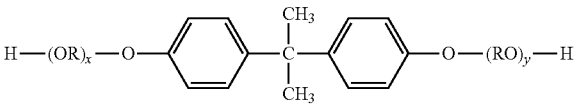

wherein RO and OR are an oxyalkylene group, wherein R is an ethylene and/or propylene group, x and y each shows the number of moles of the alkylene oxide added, each being a positive number, and the sum of x and y on average is preferably from 1 to 16, more preferably from 1 to 8, and even more preferably from 1.5 to 4; and trihydric or higher polyhydric alcohols such as glycerol, pentaerythritol, trimethylolpropane, sorbitol, and 1,4-sorbitan.

In the present invention, the carboxylic acid component of the crystalline polyester contains an aromatic dicarboxylic acid compound and an aromatic tricarboxylic or higher polycarboxylic acid compound, from the viewpoint of improving low-temperature fixing ability, high-temperature offset resistance and storage stability of the toner, and suppressing formation of uneven lines on a developer roller.

The aromatic dicarboxylic acid compound is preferably those having from 8 to 12 carbon atoms, more preferably at least one member selected from the group consisting of phthalic acid compounds, isophthalic acid compounds, and terephthalic acid compounds, and even more preferably at least one member selected from the group consisting of phthalic acid, isophthalic acid, and terephthalic acid. Here, the dicarboxylic acid compounds refer to dicarboxylic acids, acid anhydrides thereof, and alkyl(1 to 4 carbon atoms) ester thereof. Among them, dicarboxylic acid is preferred. In addition, the preferred number of carbon atoms means the number of carbon atoms of the dicarboxylic acid moiety of the dicarboxylic acid compound.

The aromatic tricarboxylic or higher polycarboxylic acid compound is preferably those having from 9 to 15 carbon atoms, more preferably at least one member selected from the group consisting of trimellitic acid compounds, 2,5,7-naphthalenetricarboxylic acid compounds, and pyromellitic acid compounds, and even more preferably at least one member selected from the group consisting of trimellitic acid, 2,5,7-naphthalenetricarboxylic acid, and pyromellitic acid. Here, the aromatic polycarboxylic acid compounds refer to polycarboxylic acids, acid anhydrides thereof, and alkyl(1 to 4 carbon atoms) ester thereof. Among them, the polycarboxylic acid is preferred. In addition, the preferred number of carbon atoms means the number of carbon atoms of the polycarboxylic acid moiety of the polycarboxylic acid compound.

Among the aromatic tricarboxylic or higher polycarboxylic acid compounds, trimellitic acid compounds are preferred, and trimellitic anhydride is more preferred, from the viewpoint of improving low-temperature fixing ability, high-temperature offset resistance and storage stability of the toner, and suppressing formation of uneven lines on a developer roller.

The aromatic dicarboxylic acid compound and the aromatic tricarboxylic or higher polycarboxylic acid compound are contained in a total amount of preferably 70% by mol or more, more preferably 80% by mol or more, even more preferably 90% by mol or more, and still even more preferably substantially 100% by mol, of the carboxylic acid component, from the viewpoint of improving low-temperature fixing ability, high-temperature offset resistance and storage stability of the toner, and suppressing formation of uneven lines on a developer roller.

The aromatic dicarboxylic acid compound is contained in an amount of preferably from 60 to 98% by mol, more preferably from 80 to 96% by mol, even more preferably from 85 to 96% by mol, still even more preferably from 90 to 96% by mol, still even more preferably from 92 to 95% by mol, and still even more preferably from 92 to 94% by mol, of the carboxylic acid component, from the viewpoint of improving high-temperature offset resistance and storage stability of the toner, and suppressing formation of uneven lines on a developer roller.

The aromatic tricarboxylic or higher polycarboxylic acid compound is contained in an amount of preferably from 2 to 20% by mol, more preferably from 4 to 18% by mol, even more preferably from 4 to 15% by mol, still even more preferably from 4 to 10% by mol, still even more preferably from 5 to 8% by mol, and still even more preferably from 6 to 8% by mol, of the carboxylic acid component, from the viewpoint of improving low-temperature fixing ability, high-temperature offset resistance and storage stability of the toner, and suppressing formation of uneven lines on a developer roller.

The aromatic dicarboxylic acid compound and the aromatic tricarboxylic or higher polycarboxylic acid compound are in a molar ratio, i.e. the aromatic dicarboxylic acid compound/the aromatic tricarboxylic or higher polycarboxylic acid compound, of preferably from 98/2 to 70/30, more preferably from 96/4 to 80/20, even more preferably from 96/4 to 85/15, still even more preferably from 96/4 to 90/10, still even more preferably from 95/5 to 92/8, and still even more preferably from 94/6 to 92/8, from the viewpoint of improving low-temperature fixing ability, high-temperature offset resistance and storage stability of the toner, and suppressing formation of uneven lines on a developer roller.

The carboxylic acid component may contain a polycarboxylic acid compound other than the aromatic dicarboxylic acid compound and the aromatic tricarboxylic or higher polycarboxylic acid compound. The polycarboxylic acid compound includes aliphatic dicarboxylic acids, such as oxalic acid, malonic acid, maleic acid, fumaric acid, citraconic acid, itaconic acid, glutaconic acid, succinic acid, adipic acid, and succinic acids substituted with an alkyl group having 1 to 30 carbon atoms or an alkenyl group having 2 to 30 carbon atoms; alicyclic dicarboxylic acids such as cyclohexanedicarboxylic acid, acid anhydrides thereof, alkyl(1 to 4 carbon atoms) esters thereof, and the like.

Also, the alcohol component may properly contain a monohydric alcohol, and the carboxylic acid component may properly contain a monocarboxylic acid compound, from the viewpoint of adjusting the molecular weight and the like.

Of the total number of moles of the carboxylic acid component and the alcohol component, which are raw material monomers for the crystalline polyester, a total number of moles of the aliphatic diol having 2 to 10 carbon atoms, the aromatic dicarboxylic acid compound and the aromatic tricarboxylic or higher polycarboxylic acid compound is preferably from 75 to 100% by mol, more preferably from 85 to 100% by mol, even more preferably from 90 to 100% by mol, and still even more preferably substantially 100% by mol, from the viewpoint of enhancement of crystallinity of the polyester, and improvements in low-temperature fixing ability, high-temperature offset resistance and storage stability of the toner, and from the viewpoint of suppression of formation of uneven lines on a developer roller.

The molar ratio of the carboxylic acid component and the alcohol component in the crystalline polyester, i.e. the carboxylic acid component/the alcohol component, is such that it is preferable that the proportion of the alcohol component is larger than the carboxylic acid component in order to achieve increased molecular weight in the crystalline polyester, and the molar ratio is preferably from 0.70 to 1.0, more preferably from 0.75 to 0.98, and even more preferably from 0.80 to 0.95.

The crystalline polyester can be produced by polycondensing the alcohol component and the carboxylic acid component in an inert gas atmosphere at a temperature of from 180° to 250° C. or so, optionally in the presence of an esterification catalyst, an esterification promoter, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter includes gallic acid, and the like. The esterification catalyst is used in an amount of preferably from 0.01 to 1.5 parts by weight, and more preferably from 0.1 to 1.0 part by weight, based on 100 parts by weight of a total amount of the alcohol component and the carboxylic acid component. The esterification promoter is used in an amount of preferably from 0.001 to 0.5 parts by weight, and more preferably from 0.01 to 0.1 parts by weight, based on 100 parts by weight of a total amount of the alcohol component and the carboxylic acid component.

The crystalline polyester has a softening point of preferably 80° C. or higher, more preferably 95° C. or higher, even more preferably 105° C. or higher, and still even more preferably 110° C. or higher, from the viewpoint of improving high-temperature offset resistance and storage stability of the toner, and suppressing formation of uneven lines on a developer roller. In addition, the crystalline polyester has a softening point of preferably 150° C. or lower, more preferably 130° C. or lower, even more preferably 125° C. or lower, and still even more preferably 120° C. or lower, from the viewpoint of improving low-temperature fixing ability of the toner. From these viewpoints taken together, the crystalline polyester has a softening point of preferably from 80° to 150° C., more preferably from 95° to 130° C., even more preferably from 105° to 125° C., and still even more preferably from 110° to 120° C.

In addition, the crystalline polyester has a temperature of maximum endothermic peak or a melting point of preferably 80° C. or higher, more preferably 95° C. or higher, even more preferably 100° C. or higher, and still even more preferably 105° C. or higher, from the viewpoint of improving high-temperature offset resistance and storage stability of the toner, and suppressing formation of uneven lines on a developer roller. Also, the crystalline polyester has a temperature of maximum endothermic peak or a melting point of preferably 150° C. or lower, more preferably 130° C. or lower, even more preferably 120° C. or lower, and still even more preferably 115° C. or lower, from the viewpoint of improving low-temperature fixing ability of the toner. From these viewpoints taken together, the crystalline polyester has a temperature of maximum endothermic peak or a melting point of preferably from 80° to 150° C., more preferably from 95° to 130° C., even more preferably from 100° to 120° C., and still even more preferably from 105° to 115° C.

The softening point and the melting point of the crystalline polyester can be adjusted by adjusting components of the raw material monomers, a polymerization initiator, a molecular weight, an amount of catalyst, or selecting reaction conditions.

In addition, the crystalline polyester has a weight-average molecular weight of 20,000 or more, preferably 30,000 or more, more preferably 35,000 or more, and even more preferably 60,000 or more, from the viewpoint of improving high-temperature offset resistance and storage stability of the toner, and suppressing formation of uneven lines on a developer roller. Also, the crystalline polyester has a weight-average molecular weight of 150,000 or less, preferably 130,000 or less, more preferably 110,000 or less, and even more preferably 90,000 or less, from the viewpoint of improving low-temperature fixing ability of the toner. From these viewpoints taken together, the crystalline polyester has a weight-average molecular weight of from 20,000 to 150,000, preferably from 30,000 to 130,000, more preferably from 35,000 to 130,000, even more preferably from 35,000 to 110,000, and still even preferably from 60,000 to 90,000.

The crystalline polyester has a number-average molecular weight of preferably 1,500 or more, more preferably 2,000 or more, even more preferably 3,000 or more, and still even more preferably 3,500 or more, from the same viewpoint. Also, the crystalline polyester has a number-average molecular weight of preferably 6,000 or less, more preferably 5,500 or less, even more preferably 5,000 or less, and still even more preferably 4,500 or less, from the same viewpoint. From these viewpoints taken together, the crystalline polyester has a number-average molecular weight of preferably from 1,500 to 6,000, more preferably from 2,000 to 5,500, even more preferably from 3,000 to 5,000, and still even more preferably from 3,500 to 4,500.

The weight-average molecular weight and the number-average molecular weight of the crystalline polyester can be adjusted by adjusting components of the raw material monomers, a polymerization initiator, a molecular weight, an amount of catalyst, or the like, or selecting reaction conditions.

In the present invention, the crystalline resin may contain a crystalline resin other than the above-mentioned crystalline polyester within the range that would not impair the effects of the present invention. The above-mentioned crystalline polyester is contained in an amount of preferably 80% by weight or more, more preferably 90% by weight or more, even more preferably 95% by weight or more, and still even more preferably substantially 100% by weight, of the crystalline resin, from the viewpoint of improving low-temperature fixing ability, high-temperature offset resistance and storage stability of the toner, and suppressing formation of uneven lines on a developer roller.

The crystalline resin other than the above-mentioned crystalline polyester includes crystalline polyesters other than the above-mentioned crystalline polyester, polyester-polyamides, and the like.

The above-mentioned crystalline polyester is contained in an amount of preferably 55% by weight or more, of the resin binder, from the viewpoint of improving low-temperature fixing ability and storage stability of the toner, and preferably 95% by weight or less, of the resin binder, from the viewpoint of improving low-temperature fixing ability, and suppressing formation of uneven lines on a developer roller. From these viewpoints taken together, the above-mentioned crystalline polyester is contained in an amount of preferably from 55 to 95% by weight, of the resin binder. Further, the above-mentioned crystalline polyester is contained in an amount of preferably from 55 to 75% by weight, more preferably from 55 to 70% by weight, even more preferably from 55 to 65% by weight, and still even more preferably from 55 to 60% by weight, of the resin binder, from the viewpoint of improving low-temperature fixing ability, and from the viewpoint of suppressing formation of uneven lines on a developer roller. On the other hand, the above-mentioned crystalline polyester is contained in an amount of preferably from 75 to 95% by weight, and more preferably from 85 to 95% by weight, of the resin binder, from the viewpoint of improving storage stability of the toner.

As the amorphous resin in the present invention, a polyester, a vinyl resin, an epoxy resin, a polycarbonate, a polyurethane, or the like is used. The amorphous resin is preferably a polyester obtained by polycondensing an alcohol component and a carboxylic acid component, from the viewpoint of improving low-temperature fixing ability, high-temperature offset resistance and storage stability of the toner, and suppressing formation of uneven lines on a developer roller.

The amorphous polyester is contained in an amount of preferably 80% by weight or more, more preferably 90% by weight or more, even more preferably 95% by weight or more, and still even more preferably substantially 100% by weight, of the amorphous resin, from the viewpoint of improving low-temperature fixing ability, high-temperature offset resistance and storage stability of the toner, and suppressing formation of uneven lines on a developer roller.

The amorphous polyester used in the present invention is preferably a polyester obtained by polycondensing an alcohol component containing an alkylene oxide adduct of bisphenol A represented by the formula (I) mentioned above, and a carboxylic acid component, from the viewpoint of acceleration amorphization of the resin, and more preferably a polyester obtained by polycondensing an alcohol component containing an alkylene oxide adduct of bisphenol A represented by the formula (I) mentioned above in an amount of 70% by mol or more, and a carboxylic acid component.

The alkylene oxide adduct of bisphenol A mentioned above is contained in an amount of preferably 70% by mol or more, more preferably from 80 to 100% by mol, even more preferably from 90 to 100% by mol, and still even more preferably substantially 100% by mol, of the alcohol component, from the viewpoint of accelerating amorphization of the amorphous resin.

As the alcohol component other than the alkylene oxide adduct of bisphenol A, the same polyhydric alcohols as used in the above-mentioned crystalline polyester can be exemplified.

As the carboxylic acid component of the amorphous polyester, both aromatic dicarboxylic acid compounds and aliphatic dicarboxylic acid compounds can be used, and specific dicarboxylic acid compounds include the same dicarboxylic acid compounds used in the above-mentioned crystalline polyester.

The carboxylic acid component preferably contains an aromatic dicarboxylic acid compound, more preferably at least one member selected from the group consisting of terephthalic acid compounds, isophthalic acid compounds, and phthalic acid compounds, even more preferably at least one member selected from the group consisting of terephthalic acid, isophthalic acid, and phthalic acid, and still even more preferably terephthalic acid, from the viewpoint of improving storage stability of the toner, and suppressing formation of uneven lines on a developer roller. The aromatic dicarboxylic acid compound is contained in an amount of preferably from 30 to 100% by mol, more preferably from 40 to 90% by mol, even more preferably from 50 to 85% by mol, and still even more preferably from 60 to 80% by mol, of the carboxylic acid component.

In addition, as the carboxylic acid component of the amorphous polyester, aside from the dicarboxylic acid compound, it is preferably to use a tricarboxylic or higher polycarboxylic acid compound, from the viewpoint of improving storage stability of the toner, and suppressing formation of uneven lines on a developer roller, and specific polycarboxylic acid compounds include the same polycarboxylic acid compounds used in the crystalline polyester.

Among the tricarboxylic or higher polycarboxylic acid compounds, the aromatic tricarboxylic or higher polycarboxylic acid compound is preferred, a trimellitic acid compound is more preferred, and trimellitic anhydride is even more preferred, from the viewpoint of improving storage stability of the toner, and suppressing formation of uneven lines on a developer roller.

The aromatic tricarboxylic or higher polycarboxylic acid compound is contained in an amount of preferably from 5 to 40% by mol, more preferably from 10 to 35% by mol, and even more preferably from 15 to 30% by mol, of the carboxylic acid component.

The amorphous polyester can be produced by polycondensing the alcohol component and the carboxylic acid component in an inert gas atmosphere at a temperature of from 180° to 250° C. or so, optionally in the presence of an esterification catalyst, an esterification promoter, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter includes gallic acid, and the like. The esterification catalyst is used in an amount of preferably from 0.01 to 1 part by weight, and more preferably from 0.1 to 0.6 parts by weight, based on 100 parts by weight of a total amount of the alcohol component and the carboxylic acid component. The esterification promoter is used in an amount of preferably from 0.001 to 0.5 parts by weight, and more preferably from 0.01 to 0.1 parts by weight, based on 100 parts by weight of a total amount of the alcohol component and the carboxylic acid component.

In the present invention, the amorphous polyester obtained by polycondensing an alcohol component and a carboxylic acid component contains not only a polyester but also a modified resin thereof.

The modified resins of polyesters include, for example, urethane-modified polyesters in which a polyester is modified with an urethane bond, epoxy-modified polyesters in which a polyester is modified with an epoxy bond, hybrid resin in which a polyester component and other resin component are formed into a composite, and the like.

The amorphous polyester has a softening point of preferably 70° C. or higher, more preferably 90° C. or higher, and even more preferably 110° C. or higher, from the viewpoint of improving high-temperature offset resistance and storage stability of the toner, and suppressing formation of uneven lines on a developer roller. In addition, the amorphous polyester has a softening point of preferably 170° C. or lower, more preferably 150° C. or lower, and even more preferably 130° C. or lower, from the viewpoint of improving low-temperature fixing ability of the toner. From these viewpoints taken together, the amorphous polyester has a softening point of preferably from 70° to 170° C., more preferably from 90° to 150° C., and even more preferably from 110° to 130° C.

The amorphous polyester has a glass transition temperature of preferably 45° C. or higher, and more preferably 55° C. or higher, from the viewpoint of improving high-temperature offset resistance and storage stability of the toner, and suppressing formation of uneven lines on a developer roller. In addition, the amorphous polyester has a glass transition temperature of preferably 80° C. or lower, and more preferably 75° C. or lower, from the viewpoint of improving low-temperature fixing ability of the toner. From these viewpoints taken together, the amorphous polyester has a glass transition temperature of preferably from 45° to 80° C., and more preferably from 55° to 75° C. Here, the glass transition temperature is a property intrinsically owned by an amorphous resin, and is distinguished from the temperature of the maximum endothermic peak.

The amorphous polyester has an acid value of preferably 30 mg KOH/g or less, more preferably 25 mg KOH/g or less, and even more preferably 22 mg KOH/g or less, from the viewpoint of suppressing formation of uneven lines of the toner on a developer roller.

The above-mentioned amorphous polyester is contained in an amount of preferably 45% by weight or less, of the resin binder, from the viewpoint of improving low-temperature fixing ability and storage stability of the toner, and the amorphous polyester is contained in an amount of preferably 5% by weight or more, of the resin binder, from the viewpoint of improving low-temperature fixing ability of the toner, and from the viewpoint of suppressing formation of uneven lines on a developer roller. From these viewpoints taken together, the amorphous polyester is contained in an amount of preferably from 5 to 45% by weight of the resin binder. Further, the amorphous polyester is contained in an amount of preferably from 25 to 45% by weight, more preferably from 30 to 45% by weight, even more preferably from 35 to 45% by weight, and still even more preferably from 40 to 45% by weight, of the resin binder, from the viewpoint of improving low-temperature fixing ability of the toner, and from the viewpoint of suppressing formation of uneven lines on a developer roller. Alternatively, the amorphous polyester is contained in an amount of preferably from 5 to 25% by weight, and more preferably from 5 to 15% by weight, of the resin binder, from the viewpoint of improving storage stability of the toner.

The crystalline resin and the amorphous resin are in a weight ratio in the resin binder, i.e. crystalline resin/amorphous resin, of from 55/45 to 95/5, from the viewpoint of improving low-temperature fixing ability and storage stability of the toner, and from the viewpoint of suppressing formation of uneven lines on a developer roller. Further, the weight ratio is preferably from 55/45 to 75/25, more preferably from 55/45 to 70/30, even more preferably from 55/45 to 65/35, and still even more preferably from 55/45 to 60/40, from the viewpoint of improving low-temperature fixing ability, and from the viewpoint of suppressing formation of uneven lines on a developer roller. The weight ratio is preferably from 75/25 to 95/5, and more preferably from 85/15 to 95/5, from the viewpoint of improving storage stability of the toner.

The toner may further contain, aside from the resin binder, a colorant, a releasing agent, a charge control agent and the like.

As the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. The colorant is contained in an amount of preferably from 1 to 40 parts by weight, and more preferably from 2 to 10 parts by weight, based on 100 parts by weight of the resin binder, from the viewpoint of improving optical density. The toner of the present invention may be any of black toners and color toners.

The releasing agent includes aliphatic hydrocarbon waxes such as low-molecular weight polypropylenes, low-molecular weight polyethylenes, low-molecular weight polypropylene-polyethylene copolymers, microcrystalline waxes, paraffinic waxes, and Fischer-Tropsch wax, and oxides thereof; ester waxes such as carnauba wax, montan wax, and sazole wax, deacidified waxes thereof, and fatty acid ester waxes; fatty acid amides, fatty acids, higher alcohols, metal salts of fatty acids, and the like. These releasing agents may be used alone or in a mixture of two or more kinds.

The releasing agent has a melting point of preferably from 60° to 160° C., and more preferably from 60° to 150° C., from the viewpoint of improving low-temperature fixing ability and high-temperature offset resistance of the toner.

The releasing agent is contained in an amount of preferably 10 parts by weight or less, more preferably 8 parts by weight or less, and even more preferably 7 parts by weight or less, based on 100 parts by weight of the resin binder, from the viewpoint of improving storage stability of the toner, and suppressing formation of uneven lines on a developer roller. In addition, the releasing agent is contained in an amount of preferably 0.5 parts by weight or more, more preferably 1.0 part by weight or more, and even more preferably 1.5 parts by weight or more, based on 100 parts by weight of the resin binder, from the viewpoint of improving high-temperature offset resistance of the toner. Therefore, from these viewpoints taken together, the releasing agent is contained in an amount of preferably from 0.5 to 10 parts by weight, more preferably from 1.0 to 8 parts by weight, and even more preferably from 1.5 to 7 parts by weight, based on 100 parts by weight of the resin binder. Alternatively, the releasing agent is contained in an amount of preferably 2.0 parts by weight or more, more preferably 2.5 parts by weight or more, and even more preferably 3.0 parts by weight or more, based on 100 parts by weight of the resin binder, from the viewpoint of enabling oil-less fusing of the toner. Therefore, from these viewpoints taken together, the releasing agent is contained in an amount of preferably from 2.0 to 10 parts by weight, more preferably from 2.5 to 8 parts by weight, and even more preferably from 3.0 to 7 parts by weight, based on 100 parts by weight of the resin binder.

The charge control agent is not particularly limited. The negatively chargeable charge control agent includes metal-containing azo dyes, for example, "BONTRON S-28" commercially available from Orient Chemical Industries Co., Ltd., "T-77" commercially available from Hodogaya Chemical Co., Ltd., "BONTRON S-34" commercially available from Orient Chemical Industries Co., Ltd., "AIZEN SPILON BLACK TRH" commercially available from Hodogaya Chemical Co., Ltd., and the like; copper phthalocyanine dyes; metal complexes of alkyl derivatives of salicylic acid, for example, "BONTRON E-81," "BONTRON E-84," "BONTRON E-304," hereinabove commercially available from Orient Chemical Industries Co., Ltd., and the like; nitroimidazole derivatives; boron complexes of benzilic acid, for example, "LR-147" commercially available from Japan Carlit, Ltd.; nonmetallic charge control agents, for example, "BONTRON F-21," "BONTRON E-89," hereinabove commercially available from Orient Chemical Industries Co., Ltd., "T-8" commercially available from Hodogaya Chemical Co., Ltd., "FCA-2521NJ," "FCA-2508N," hereinabove commercially available from FUJIKURA KASEI CO., LTD., and the like.

The positively chargeable charge control agent includes Nigrosine dyes, for example, "BONTRON N-01," "BONTRON N-04," "BONTRON N-07," hereinabove commercially available from Orient Chemical Industries Co., Ltd., "CHUO CCA-3" commercially available from CHUO GOUSEI KAGAKU CO., LTD., and the like; triphenylmethane-based dyes containing a tertiary amine as a side chain; quaternary ammonium salt compounds, for example, "BONTRON P-51" commercially available from Orient Chemical Industries Co., Ltd., "TP-415" commercially available from Hodogaya Chemical Co., Ltd., cetyltrimethylammonium bromide, "COPY CHARGE PX VP435" commercially available from Clariant Japan, Ltd.; and the like.

The charge control agent is contained in an amount of preferably 0.1 parts by weight or more, and more preferably 0.2 parts by weight or more, based on 100 parts by weight of the resin binder, from the viewpoint of improving triboelectric stability of the toner. In addition, the charge control agent is contained in an amount of preferably 5 parts by weight or less, and more preferably 3 parts by weight or less, based on 100 parts by weight of the resin binder, from the viewpoint of adjustment of triboelectric charges of the toner to an appropriate level to provide improvement in developability. In other words, taken together these viewpoints, the charge control agent is contained in an amount of preferably from 0.1 to 5 parts by weight, and more preferably from 0.2 to 3 parts by weight, based on 100 parts by weight of the resin binder.

The toner in the present invention may further properly contain an additive such as a magnetic particulate, a fluidity improver, an electric conductivity modifier, an extender pigment, a reinforcing filler such as a fibrous material, an antioxidant, an anti-aging agent, or a cleanability improver.

The toner of the present invention may be a toner obtained by any of conventionally known methods such as a melt-kneading method, an emulsion aggregation method, and a polymerization method, and a pulverized toner produced by the melt-kneading method is preferred, from the viewpoint of productivity and colorant dispersibility. Specifically, the toner particles can be produced by homogeneously mixing raw materials such as a resin binder, a colorant, a charge control agent and a releasing agent with a mixer such as a Henschel mixer, thereafter melt-kneading the mixture, cooling, pulverizing, and classifying the product. On the other hand, a toner produced by the polymerization method or the emulsion aggregation method is preferred from the viewpoint of the production of toners having smaller particle sizes.

The melt-kneading of the raw materials can be carried out with a known kneader, such as a closed kneader, a single-screw or twin-screw extruder, or a continuous open-roller type kneader. Since the additives can be efficiently highly dispersed in the resin binder without repeats of kneading or without a dispersion aid, a continuous open-roller type kneader provided with feeding ports and a discharging port for a kneaded product along the shaft direction of the roller is preferably used.

It is preferable that the raw materials for a toner are previously homogeneously mixed with a Henschel mixer, a Super-Mixer or the like, and thereafter fed to an open-roller type kneader, and the raw materials may be fed from one feeding port, or dividedly fed to the kneader from plural feeding ports. It is preferable that the raw materials for the toner are fed to the kneader from one feeding port, from the viewpoint of easiness of operation and simplification of an apparatus.

The continuous open-roller type kneader refers to a kneader of which kneading member is an open type, not being tightly closed, and the kneading heat generated during the kneading can be easily dissipated. In addition, it is desired that the continuous open-roller type kneader is a kneader provided with at least two rollers. The continuous open-roller type kneader used in the present invention is a kneader provided with two rollers having different peripheral speeds, in other words, two rollers of a high-rotation roller having a high peripheral speed and a low-rotation roller having a low peripheral speed. In the present invention, it is desired that the high-rotation roller is a heat roller, and the low-rotation roller is a cooling roller, from the viewpoint of improvement in dispersibility of the raw materials for a toner, such as a colorant and a releasing agent, in the resin binder.

The temperature of the roller can be adjusted by, for example, a temperature of a heating medium passing through the inner portion of the roller, and each roller may be divided in two or more portions in the inner portion of the roller, each being communicated with heating media of different temperatures.

The temperature at the end part of the raw material supplying side of the high-rotation roller is preferably from 100° to 160° C., and the temperature at the end part of the raw material supplying side of the low-rotation roller is preferably from 35° to 100° C.

In the high-rotation roller, the difference between a setting temperature at the end part of the raw material supplying side and a setting temperature at the end part of the kneaded product discharging side is preferably from 20° to 60° C., more preferably from 20° to 50° C., and even more preferably from 30° to 50° C., from the viewpoint of prevention in detachment of the kneaded product from the roller. In the low-rotation roller, the difference between a setting temperature at the end part of the raw material supplying side and a setting temperature at the end part of the kneaded product discharging side is preferably from 0° to 50° C., more preferably from 0° to 40° C., and even more preferably from 0° to 20° C., from the viewpoint of improvement in dispersibility of the raw materials for a toner, such as a colorant and a releasing agent, in the resin binder.

The peripheral speed of the high-rotation roller is preferably from 2 to 100 m/min, and more preferably from 5 to 75 m/min. The peripheral speed of the low-rotation roller is preferably from 1 to 90 m/min, more preferably from 2 to 60 m/min, and even more preferably from 4 to 50 m/min. In addition, the ratio between the peripheral speeds of the two rollers, i.e., low-rotation roller/high-rotation roller, is preferably from 1/10 to 9/10, and more preferably from 3/10 to 8/10.

Structures, size, materials and the like of the roller are not particularly limited. Also, the surface of the roller may be any of smooth, wavy, rugged, or other surfaces. In order to increase kneading share, it is preferable that plural spiral ditches are engraved on the surface of each roller.

The pulverizing step may be carried out in divided multi-stages. For example, the melt-kneaded mixture may be roughly pulverized to a size of from 1 to 5 mm or so, and the roughly pulverized product may be further finely pulverized to a desired particle size.

The pulverizer used in the pulverizing step is not particularly limited. For example, the pulverizer used preferably in the rough pulverization includes an atomizer, Rotoplex, and the like, and the pulverizer used preferably in the fine pulverization includes a jet mill, an impact type mill, a rotary mechanical mill, and the like.

The classifier used in the classifying step includes an air classifier, a rotor type classifier, a sieve classifier, and the like. The pulverized product which is insufficiently pulverized and removed during the classifying step may be subjected to the pulverizing step again.

The toner obtained by the present invention has a volume-median particle size $D_{50}$ of preferably from 3 to 15 μm, and more preferably from 4 to 12 μm, from the viewpoint of improving the image quality of the toner. The term "volume-median particle size $D_{50}$" as used herein means a particle size of which cumulative volume frequency calculated on a volume percentage is 50% counted from the smaller particle sizes.

The toner particles, which are also referred to as toner matrix particles, are subjected to an external additive treatment of adhering an external additive to thereby add the external additive to the toner particles.

The external additive includes, for example, inorganic particles of silica, alumina, titania, zirconia, tin oxide, zinc oxide, and the like, and fine organic particles such as resin particles, such as fine melamine resin particles and fine polytetrafluoroethylene resin particles. Among them, it is preferable to use silicas in combination, and it is even more preferable to use together a silica having an average particle size of less than 20 nm and a silica having an average particle size of 20 nm or more at a weight ratio of from 90/10 to 10/90.

The toner of the present invention which is suitable for speeding-up and miniaturization of the apparatus, and is capable of low-temperature fixing can maintain excellent high-temperature offset resistance and gloss, even when used in an apparatus for forming fixed images such as full-color printers and full-color copy machines. Therefore, the toner of the present invention can be suitably used in a method for forming fixed images using a color developing device. Further, the toner of the present invention can also be suitably used in an oil-less nonmagnetic monocomponent developing device. Here, the oil-less fusing refers to a method using a fixing device having a heat roller fixing device not provided with an oil-supplying device. The oil-supplying device refers to a device comprising an oil tank, and a mechanism of applying an oil quantitatively on a heat roller surface; a device having a mechanism of contacting a roller previously immersed in an oil with a heat roller; and the like.

Regarding the embodiments mentioned above, the present invention will further disclose the following toner for electrostatic image development.

<1> A toner for electrostatic image development containing at least a resin binder, the resin binder being composed of a crystalline resin and an amorphous resin, wherein the crystalline resin contains a crystalline polyester obtained by polycondensing an alcohol component containing an aliphatic diol having 2 to 10 carbon atoms and a carboxylic acid component containing an aromatic dicarboxylic acid compound and an aromatic tricarboxylic or higher polycarboxylic acid compound, wherein the crystalline polyester has a weight-average molecular weight of from 20,000 to 150,000, and wherein the crystalline resin and the amorphous resin are in a weight ratio, i.e. crystalline resin/amorphous resin, of from 55/45 to 95/5.

<2> The toner for electrostatic image development according to the above <1>, wherein the crystalline polyester is contained in an amount of 80% by weight or more, preferably 90% by weight or more, more preferably 95% by weight or more, and even more preferably substantially 100% by weight, of the crystalline resin.

<3> The toner for electrostatic image development according to the above <1> or <2>, wherein the aliphatic diol having 2 to 10 carbon atoms is contained in an amount of 70% by mol or more, preferably 80% by mol or more, more preferably 90% by mol or more, and even more preferably substantially 100% by mol of the alcohol component of the crystalline polyester.

<4> The toner for electrostatic image development according to any one of the above <1> to <3>, wherein the aromatic dicarboxylic acid compound and the aromatic tricarboxylic or higher polycarboxylic acid compound are contained in a total amount of 70% by mol or more, preferably 80% by mol or more, more preferably 90% by mol or more, and even more preferably substantially 100% by mol, of the carboxylic acid component of the crystalline polyester.

<5> The toner for electrostatic image development according to any one of the above <1> to <4>, wherein the aromatic tricarboxylic or higher polycarboxylic acid compound is contained in an amount of from 2 to 20% by mol, preferably from 4 to 18% by mol, more preferably from 4 to 15% by mol, even more preferably from 4 to 10% by mol, still even more preferably from 5 to 8% by mol, and still even more preferably from 6 to 8% by mol, of the carboxylic acid component of the crystalline polyester.

<6> The toner for electrostatic image development according to any one of the above <1> to <5>, wherein the aromatic dicarboxylic acid compound is contained in an amount of from 60 to 98% by mol, preferably from 80 to 96% by mol, more preferably from 85 to 96% by mol, even more preferably from 90 to 96% by mol, still even more preferably from 92 to 95% by mol, and still even more preferably from 92 to 94% by mol, of the carboxylic acid component of the crystalline polyester.

<7> The toner for electrostatic image development according to any one of the above <1> to <6>, wherein the crystalline polyester has a weight-average molecular weight of 20,000 or more, preferably 30,000 or more, more preferably 35,000 or more, and even more preferably 60,000 or more, and 150,000 or less, preferably 130,000 or less, more preferably 110,000 or less, and even more preferably 90,000 or less.

<8> The toner for electrostatic image development according to any one of the above <1> to <7>, wherein the crystalline polyester has a number-average molecular weight of 1,500 or more, preferably 2,000 or more, more preferably 3,000 or more, and even more preferably 3,500 or more, and 6,000 or less, preferably 5,500 or less, more preferably 5,000 or less, and even more preferably 4,500 or less.

<9> The toner for electrostatic image development according to any one of the above <1> to <8>, wherein the crystalline resin and the amorphous resin are in a weight ratio, i.e. crystalline resin/amorphous resin, of from 55/45 to 75/25, preferably from 55/45 to 70/30, more preferably from 55/45 to 65/35, and even more preferably from 55/45 to 60/40.

<10> The toner for electrostatic image development according to any one of the above <1> to <8>, wherein the crystalline resin and the amorphous resin are in a weight ratio, i.e. crystalline resin/amorphous resin, of from 75/25 to 95/5, and preferably from 85/15 to 95/5.

<11> The toner for electrostatic image development according to any one of the above <1> to <10>, wherein the aromatic dicarboxylic acid compound and the aromatic tricarboxylic or higher polycarboxylic acid compound are in a molar ratio, i.e. the aromatic dicarboxylic acid compound/the aromatic tricarboxylic or higher polycarboxylic acid compound, of from 98/2 to 70/30, preferably from 96/4 to 80/20, more preferably from 96/4 to 85/15, even more preferably from 96/4 to 90/10, still even more preferably from 95/5 to 92/8, and still even more preferably from 94/6 to 92/8.

<12> The toner for electrostatic image development according to any one of the above <1> to <11>, wherein the aliphatic diol having 2 to 10 carbon atoms of the alcohol component of the crystalline polyester is at least one member selected from the group consisting of α,ω-linear alkanediols comprising ethylene glycol, 1,3-propylene glycol, 1,4-butanediol, 1,5-pentanediol, 1,6-hexanediol, 1,7-heptanediol, 1,8-octanediol, 1,9-nonanediol, and 1,10-decanediol; 1,2-propylene glycol, neopentyl glycol, and 1,4-butenediol, and preferably at least one α,ω-linear alkanediol selected from the group consisting of ethylene glycol, 1,3-propylene glycol, 1,4-butanediol, 1,5-pentanediol, 1,6-hexanediol, 1,7-heptanediol, 1,8-octanediol, 1,9-nonanediol, and 1,10-decanediol, and more preferably one or more members selected from 1,4-butanediol and 1,6-hexanediol.

<13> The toner for electrostatic image development according to any one of the above <1> to <11>, wherein the aliphatic diol having 2 to 10 carbon atoms of the alcohol component of the crystalline polyester has from 4 to 8 carbon atoms, and preferably from 4 to 6 carbon atoms.

<14> The toner for electrostatic image development according to any one of the above <1> to <13>, wherein the aromatic dicarboxylic acid compound of the carboxylic acid component of the crystalline polyester is those having from 8 to 12 carbon atoms, preferably at least one member selected from the group consisting of phthalic acid compounds, isophthalic acid compounds, and terephthalic acid compounds, and more preferably at least one member selected from the group consisting of phthalic acid, isophthalic acid, and terephthalic acid.

<15> The toner for electrostatic image development according to any one of the above <1> to <14>, wherein the aromatic tricarboxylic or higher polycarboxylic acid compound of the carboxylic acid component of the crystalline polyester is those having from 9 to 15 carbon atoms, preferably at least one member selected from the group consisting of trimellitic acid compounds, 2,5,7-naphthalenetricarboxylic acid compounds, and pyromellitic acid compounds, more preferably trimellitic acid compounds, and even more preferably trimellitic anhydride.

<16> The toner for electrostatic image development according to any one of the above <1> to <15>, wherein of the total number of moles of the carboxylic acid component and the alcohol component, which are raw material monomers for the crystalline polyester, a total number of moles of the aliphatic diol having 2 to 10 carbon atoms, the aromatic dicarboxylic acid compound and the aromatic tricarboxylic or higher polycarboxylic acid compound is from 75 to 100% by mol, more preferably from 85 to 100% by mol, even more preferably from 90 to 100% by mol, and still even more preferably substantially 100% by mol.

<17> The toner for electrostatic image development according to any one of the above <1> to <16>, wherein the crystalline polyester has a softening point of 80° C. or higher, preferably 95° C. or higher, more preferably 105° C. or higher, and even more preferably 110° C. or higher, and 150° C. or lower, preferably 130° C. or lower, more preferably 125° C. or lower, and even more preferably 120° C. or lower.

<18> The toner for electrostatic image development according to any one of the above <1> to <17>, wherein the crystalline polyester has a temperature of maximum endothermic peak or a melting point of 80° C. or higher, preferably 95° C. or higher, more preferably 100° C. or higher, and even more preferably 105° C. or higher, and 150° C. or lower, preferably 130° C. or lower, more preferably 120° C. or lower, and even more preferably 115° C. or lower.

<19> The toner for electrostatic image development according to any one of the above <1> to <18>, wherein the crystalline polyester is contained in an amount of from 55 to 95% by weight, preferably from 55 to 75% by weight, more preferably from 55 to 70% by weight, even more preferably from 55 to 65% by weight, and still even more preferably from 55 to 60% by weight, of the resin binder.

<20> The toner for electrostatic image development according to any one of the above <1> to <18>, wherein the crystalline polyester is contained in an amount of from 55 to 95% by weight, preferably from 75 to 95% by weight, and more preferably from 85 to 95% by weight, of the resin binder.

<21> The toner for electrostatic image development according to any one of the above <1> to <20>, wherein the amorphous resin is an amorphous polyester.

<22> The toner for electrostatic image development according to the above <21>, wherein the amorphous polyester is a polyester obtained by polycondensing an alcohol component containing an alkylene oxide adduct of bisphenol A represented by the formula (I), and a carboxylic acid component.

<23> The toner for electrostatic image development according to the above <21> or <22>, wherein the amorphous polyester is contained in an amount of 80% by weight or more, preferably 90% by weight or more, more preferably 95% by weight or more, and even more preferably substantially 100% by weight, of the amorphous resin.

<24> The toner for electrostatic image development according to any one of the above <21> to <23>, wherein the alkylene oxide adduct of bisphenol A represented by the formula (I) is contained in an amount of 70% by mol or more, preferably from 80 to 100% by mol, more preferably from 90 to 100% by mol, and even more preferably substantially 100% by mol, of the alcohol component of the amorphous polyester.

<25> The toner for electrostatic image development according to any one of the above <21> to <24>, wherein the carboxylic acid component of the amorphous polyester contains an aromatic dicarboxylic acid compound, preferably at least one member selected from the group consisting of terephthalic acid compounds, isophthalic acid compounds, and phthalic acid compounds, more preferably at least one member selected from the group consisting of terephthalic acid, isophthalic acid, and phthalic acid, and still even more preferably terephthalic acid.

<26> The toner for electrostatic image development according to any one of the above <21> to <25>, wherein the aromatic dicarboxylic acid compound is contained in an amount of from 30 to 100% by mol, preferably from 40 to 90% by mol, more preferably from 50 to 85% by mol, and even more preferably from 60 to 80% by mol, of the carboxylic acid component of the amorphous polyester.

<27> The toner for electrostatic image development according to any one of the above <21> to <26>, wherein the carboxylic acid component of the amorphous polyester contains an aromatic tricarboxylic or higher polycarboxylic acid compound, preferably a trimellitic acid compound, and more preferably trimellitic anhydride.

<28> The toner for electrostatic image development according to any one of the above <21> to <27>, wherein the aromatic tricarboxylic or higher polycarboxylic acid compound is contained in an amount of from 5 to 40% by mol, preferably from 10 to 35% by mol, and more preferably from 15 to 30% by mol, of the carboxylic acid component of the amorphous polyester.

<29> The toner for electrostatic image development according to any one of the above <21> to <28>, wherein the amorphous polyester has a softening point of 70° C. or higher, preferably 90° C. or higher, and more preferably 110° C. or higher, and 170° C. or lower, preferably 150° C. or lower, and more preferably 130° C. or lower.

<30> The toner for electrostatic image development according to any one of the above <21> to <29>, wherein the amorphous polyester has a glass transition temperature of 45° C. or higher, and preferably 55° C. or higher, and 80° C. or lower, and preferably 75° C. or lower.

<31> The toner for electrostatic image development according to any one of the above <21> to <30>, wherein the amorphous polyester is contained in an amount of from 5 to 45% by weight, preferably from 25 to 45% by weight, more preferably from 30 to 45% by weight, even more preferably from 35 to 45% by weight, and still even more preferably from 40 to 45% by weight, of the resin binder.

<32> The toner for electrostatic image development according to any one of the above <21> to <30>, wherein the amorphous polyester is contained in an amount of preferably from 5 to 45% by weight, preferably from 5 to 25% by weight, and more preferably from 5 to 15% by weight, of the resin binder.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which half of the sample flows out, when plotting a downward movement of a plunger of a flow tester commercially available from Shimadzu Corporation, CAPILLARY RHEOMETER "CFT-500D", against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Temperature of Maximum Endothermic Peak and Melting Point of Resin]

Measurements were taken using a differential scanning calorimeter "Q-100," commercially available from TA Instruments, Japan, by cooling a 0.01 to 0.02 g sample weighed out in an aluminum pan from room temperature to 0° C. at a cooling rate of 10° C./min, allowing the cooled sample to stand for 1 minute, and thereafter heating the sample at a rate of 50° C./min. Among the endothermic peaks observed, the temperature of an endothermic peak on the highest temperature side is defined as a temperature of maximum endothermic peak. When a difference between the temperature of maximum endothermic peak and the softening point is within 20° C., the temperature of maximum endothermic peak is defined as a melting point.

[Glass Transition Temperature of Amorphous Resin]

Measurements were taken using a differential scanning calorimeter "Q-100," commercially available from TA Instruments, Japan, by heating a 0.01 to 0.02 g sample weighed out in an aluminum pan to 200° C. and cooling the sample from that temperature to 0° C. at a cooling rate of 10° C./min. Next, the sample was measured while heating at a rate of 10° C./min. A temperature of an intersection of the extension of the baseline of equal to or lower than the temperature of maximum endothermic peak and the tangential line showing the maximum inclination between the kick-off of the peak and the top of the peak in the above measurement is defined as a glass transition temperature.

[Weight-Average Molecular Weight and Number-Average Molecular Weight of Resin]

The molecular weight distribution is determined by gel permeation chromatography (GPC) method in accordance with the following methods. The weight-average molecular weight and the number-average molecular weight are calculated from the molecular weight distribution obtained.

(1) Preparation of Sample Solution

A sample is dissolved in chloroform at 25° C., so as to have a concentration of 0.5 g/100 mL. Next, this solution is filtered with a fluororesin filter having a pore size of 0.2 μm commercially available from ADVANTEC, DISMIC-25JP to remove an insoluble component, to provide a sample solution.

(2) Determination of Molecular Weights

Using the following measurement apparatus and analytical column, chloroform is allowed to flow as an eluant at a rate of 1 ml per minute, and the column is stabilized in a thermostat at 40° C. One-hundred microliters of the sample solution is injected to the column to take the measurements. The molecular weight of the sample is calculated on the basis of a calibration curve previously prepared. As the calibration curve of the molecular weight, one prepared by using several kinds of monodisperse polystyrenes as standard samples is used. The calibration curve is drawn using monodisperse polystyrenes A-500 ($5.0\times10^2$), A-1000 ($1.01\times10^3$), A-2500 ($2.63\times10^3$), A-5000 ($5.97\times10^3$), F-1 ($1.02\times10^4$), F-2 ($1.81\times10^4$), F-4 ($3.97\times10^4$), F-10 ($9.64\times10^4$), F-20 ($1.90\times10^5$), F-40 ($4.27\times10^5$), F-80 ($7.06\times10^5$), and F-128 ($1.09\times10^6$).

Measurement Apparatus: LC-9130NEXT commercially available from Japan Analytical Industry Co., Ltd.

Analytical Column: TSK Gel HXL-H+GMHXL+G3000HXL commercially available from Tosoh Corporation

[Acid Value of Resin]

The acid value is determined by a method according to JIS K0070 except that only the determination solvent is changed from a mixed solvent of ethanol and ether as defined in JIS K0070 to a mixed solvent of acetone and toluene at a volume ratio of acetone:toluene=1:1.

[Melting Point of Releasing Agent]

A temperature of maximum endothermic peak of the heat of fusion obtained using a differential scanning calorimeter "DSC 210," commercially available from Seiko Instruments, Inc., by raising the temperature of a sample to 200° C., cooling the sample from this temperature to 0° C. at a cooling rate of 10° C./min, and thereafter raising the temperature of the sample at a heating rate of 10° C./min, is referred to as a melting point.

[Average Particle Size of External Additive]

Particle sizes were determined for 500 particles from a photograph taken with a scanning electron microscope (SEM), an average of length and breadth of the particles of which is taken, and the average is referred to as an average particle size.

[Volume-Median Particle Size $D_{50}$ of Toner]

Measuring Apparatus: Coulter Multisizer II commercially available from Beckman Coulter, Inc.

Aperture Diameter: 50 μm

Analyzing Software: Coulter Multisizer AccuComp Ver. 1.19 commercially available from Beckman Coulter, Inc.

Electrolytic solution: "Isotone II" commercially available from Beckman Coulter, Inc.

Dispersion: "EMULGEN 109P" commercially available from Kao Corporation, polyoxyethylene lauryl ether, HLB: 13.6, is dissolved in the above electrolytic solution so as to have a concentration of 5% by weight to provide a dispersion.

Dispersion Conditions: Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size $D_{50}$ is obtained from the particle size distribution.

Production Example of Resin A

A 10-liter four-neck flask equipped with a nitrogen inlet tube, a dehydration tube, a stirrer, and a thermocouple was charged with raw material monomers other than trimellitic anhydride, and an esterification catalyst, in amounts used as listed in Table 1. The components were reacted at 200° C. in a nitrogen atmosphere until a reaction percentage reached 90%, and the reaction mixture was then reacted at 8 kPa for 1 hour. Subsequently, the temperature was raised to 205° C., and the pressure was recovered to a normal pressure. Thereafter, trimellitic anhydride was supplied thereto, and the components were reacted at 205° C. and normal pressure for 1 hour, and thereafter reacted at 205° C. and 10.7 kPa for 1 hour, to provide a resin A. The physical properties of the resin A obtained are shown in Table 1. Here, the reaction percentage refers to a value calculated by [amount of water generated/theoretical amount of water generated]×100.

Production Example of Resin B

A 10-liter four-neck flask equipped with a nitrogen inlet tube, a dehydration tube, a stirrer, and a thermocouple was charged with raw material monomers other than trimellitic anhydride, and an esterification catalyst, in amounts used as listed in Table 1. The components were reacted at 200° C. in a nitrogen atmosphere until a reaction percentage reached 90%, and the reaction mixture was then reacted at 8 kPa for 1 hour. Subsequently, the pressure was recovered to a normal pressure, and trimellitic anhydride was then supplied thereto, and the components were reacted at 200° C. and normal pressure for 2 hours, to provide a resin B. The physical properties of the resin B obtained are shown in Table 1.

Production Example of Resin C

A 10-liter four-neck flask equipped with a nitrogen inlet tube, a dehydration tube, a stirrer, and a thermocouple was charged with raw material monomers other than trimellitic anhydride, and an esterification catalyst, in amounts used as listed in Table 1. The components were reacted at 200° C. in a nitrogen atmosphere until a reaction percentage reached 90%, and the reaction mixture was then reacted at 8 kPa for 1 hour. Subsequently, the pressure was recovered to a normal pressure, and trimellitic anhydride was then supplied thereto, and the components were reacted at 200° C. and normal pressure for 1 hour, and thereafter reacted at 200° C. and 10.7 kPa for 1 hour, to provide a resin C. The physical properties of the resin C obtained are shown in Table 1.

Production Example of Resin D

A 10-liter four-neck flask equipped with a nitrogen inlet tube, a dehydration tube, a stirrer, and a thermocouple was charged with raw material monomers other than trimellitic anhydride, and an esterification catalyst, in amounts used as listed in Table 1. The components were reacted at 200° C. in a nitrogen atmosphere until a reaction percentage reached 90%, and the reaction mixture was then reacted at 8 kPa for 1 hour. Subsequently, the temperature was raised to 210° C., and the pressure was recovered to a normal pressure. Thereafter, trimellitic anhydride was supplied thereto, and the components were reacted at 210° C. and normal pressure for 1 hour, and thereafter reacted at 210° C. and 10.7 kPa for 1 hour, to provide a resin D. The physical properties of the resin D obtained are shown in Table 1.

Production Example of Resin E

A 10-liter four-neck flask equipped with a nitrogen inlet tube, a dehydration tube, a stirrer, and a thermocouple was charged with raw material monomers other than fumaric acid, trimellitic anhydride and a polymerization inhibitor, and an esterification catalyst, in amounts used as listed in Table 1. The components were reacted at 200° C. in a nitrogen atmosphere until a reaction percentage reached 90%, and the reaction mixture was then reacted at 8 kPa for 1 hour. Thereafter, the reaction mixture was cooled to 180° C., and the pressure was recovered to a normal pressure. Thereafter, fumaric acid, trimellitic anhydride and a polymerization inhibitor were supplied thereto, and the components were heated to 200° C. over 2 hours, and thereafter reacted at 200° C. and 10.7 kPa for 2 hour, to provide a resin E. The physical properties of the resin E obtained are shown in Table 1.

Production Example of Resin F

A 10-liter four-neck flask equipped with a nitrogen inlet tube, a dehydration tube, a stirrer, and a thermocouple was charged with raw material monomers other than trimellitic anhydride, and an esterification catalyst, in amounts used as listed in Table 1. The components were reacted at 200° C. in a nitrogen atmosphere until a reaction percentage reached 90%, and the reaction mixture was then reacted at 8 kPa for 1 hour. Subsequently, the pressure was recovered to a normal pressure, and trimellitic anhydride was then supplied thereto, and the components were reacted at 200° C. and normal pressure for 1 hour, and thereafter reacted at 200° C. and 10.7 kPa for 1 hour, to provide a resin F. The physical properties of the resin F obtained are shown in Table 1.

Production Example of Resin G

A 10-liter four-neck flask equipped with a nitrogen inlet tube, a dehydration tube, a stirrer, and a thermocouple was charged with raw material monomers other than trimellitic anhydride, and an esterification catalyst, in amounts used as listed in Table 1. The components were reacted at 200° C. in a nitrogen atmosphere until a reaction percentage reached 90%, and the reaction mixture was then reacted at 8 kPa for 1 hour. Subsequently, the pressure was recovered to a normal pressure, and trimellitic anhydride was then supplied thereto, and the components were reacted at 200° C. and normal pressure for 1 hour, and thereafter reacted at 200° C. and 10.7 kPa for 1 hour, to provide a resin G. The physical properties of the resin G obtained are shown in Table 1.

Production Examples of Resins H and J

A 10-liter four-neck flask equipped with a nitrogen inlet tube, a dehydration tube, a stirrer, and a thermocouple was charged with raw material monomers, an esterification catalyst and a polymerization inhibitor, in amounts used as listed in Table 1. The components were heated from 130° to 200° C. over 10 hours in a nitrogen atmosphere, and reacted at 200° C. and 8 kPa for 1 hour to provide each of resins H and J. The physical properties of the resins H and J obtained are shown in Table 1.

Production Example of Resin I

A 10-liter four-neck flask equipped with a nitrogen inlet tube, a dehydration tube, a stirrer, and a thermocouple was charged with raw material monomers and an esterification catalyst, in amounts used as listed in Table 1. The components were reacted at 210° C. in a nitrogen atmosphere until a reaction percentage reached 90%, and the reaction mixture was then reacted at 8 kPa for 2 hours, to provide a resin I. The physical properties of the resin I obtained are shown in Table 1.

TABLE 1

| | Resin A | Resin B | Resin C | Resin D | Resin E |
|---|---|---|---|---|---|
| Raw Material Monomers[1)] | | | | | |
| 1,6-Hexanediol | 2891 g (70) | 2891 g (70) | 2891 g (70) | 2891 g (70) | 2891 g (70) |
| 1,4-Butanediol | 945 g (30) | 945 g (30) | 945 g (30) | 945 g (30) | 945 g (30) |
| Terephthalic Acid | 4648 g (80) | 4648 g (80) | 4648 g (80) | 4648 g (80) | 4067 g (70) |

TABLE 1-continued

| | | | | | |
|---|---|---|---|---|---|
| Trimellitic Anhydride | 403.2 g (6) | 403.2 g (6) | 403.2 g (6) | 403.2 g (6) | 403.2 g (6) |
| Fumaric Acid | — | — | — | — | 406 g (10) |
| Esterification Catalyst[2)] | | | | | |
| Tin(II) 2-Ethylhexanoate | 44.4 g (0.5) | 44.4 g (0.5) | 44.4 g (0.5) | 44.4 g (0.5) | 43.6 g (0.5) |
| Polymerization Inhibitor[2)] | | | | | |
| t-Butylcatechol | — | — | — | — | 4.7 g (0.05) |
| Physical Properties of Resin | | | | | |
| Softening Point (° C.) | 116 | 108 | 113 | 119 | 110 |
| Temperature of Maximum Endothermic Peak (° C.) | 110 | 110 | 110 | 111 | 102 |
| Softening Point/Temperature of Maximum Endothermic Peak | 1.1 | 1.0 | 1.0 | 1.1 | 1.1 |
| Weight-Average Molecular Weight | 72,000 | 11,000 | 36,000 | 109,000 | 59,000 |
| Number-Average Molecular Weight | 4,000 | 1,100 | 3,300 | 4,900 | 3,700 |
| | Resin F | Resin G | Resin H | Resin I | Resin J |
| Raw Material Monomers[1)] | | | | | |
| 1,6-Hexanediol | 2891 g (70) | 2891 g (70) | 4130 g (100) | 2891 g (70) | 2891 g (70) |
| 1,4-Butanediol | 945 g (30) | 945 g (30) | — | 945 g (30) | 945 g (30) |
| Terephthalic Acid | 4997 g (86) | 4299 g (74) | — | 5520 g (95) | — |
| Trimellitic Anhydride | 134.4 g (2) | 672 g (10) | — | — | — |
| Fumaric Acid | — | — | 4060 g (100) | — | 4060 g (100) |
| Esterification Catalyst[2)] | | | | | |
| Tin(II) 2-Ethylhexanoate | 44.8 g (0.5) | 44.0 g (0.5) | 41.0 g (0.5) | 46.7 g (0.5) | 41.0 g (0.5) |
| Polymerization Inhibitor[2)] | | | | | |
| t-Butylcatechol | — | — | 4.1 g (0.05) | — | 4.1 g (0.05) |
| Physical Properties of Resin | | | | | |
| Softening Point (° C.) | 114 | 124 | 110 | 123 | 86 |
| Temperature of Maximum Endothermic Peak (° C.) | 118 | 108 | 111 | 128 | 84 |
| Softening Point/Temperature of Maximum Endothermic Peak | 1.0 | 1.2 | 1.0 | 1.0 | 1.0 |
| Weight-Average Molecular Weight | 32,000 | 124,000 | 55,000 | 41,000 | 71,000 |
| Number-Average Molecular Weight | 2,300 | 3,400 | 5,800 | 3,100 | 6,100 |

[1)]The numerical figures inside the parenthesis are expressed by molar ratio supposing that a total of the alcohol component is 100.
[2)]The numerical figures inside the parenthesis are expressed by parts by weight based on 100 parts by weight of the raw material monomers.

Production Example of Amorphous Resin a

A 10-liter four-neck flask equipped with a nitrogen inlet tube, a dehydration tube, a stirrer, and a thermocouple was charged with 3486 g of polyoxypropylene(2.2)-2,2-bis(4-hydroxyphenyl)propane, 3240 g of polyoxyethylene(2.2)-2,2-bis(4-hydroxyphenyl)propane, 1881 g of terephthalic acid, 269 g of tetrapropenylsuccinic anhydride, 30 g of tin(II) 2-ethylhexanoate, and 2 g of gallic acid. The components were reacted in a nitrogen atmosphere at 230° C. until a reaction percentage reached 90%, and the reaction was then carried out at 8.3 kPa for 1 hour. Next, the temperature was lowered to 220° C., and the pressure was recovered to a normal pressure. Thereafter, trimellitic anhydride was supplied thereto, and the components were reacted at 220° C. until a softening point reached 122° C., to provide an amorphous polyester, Resin a. The resin a had a softening point of 122° C., a glass transition temperature of 64° C., a temperature of maximum endothermic peak of 65° C., a ratio of softening point/temperature of maximum endothermic peak of 1.9, and an acid value of 18.9 mg KOH/g.

Production Example of Amorphous Resin b

A 10-liter four-neck flask equipped with a nitrogen inlet tube, a dehydration tube, a stirrer, and a thermocouple was charged with 3486 g of polyoxypropylene(2.2)-2,2-bis(4-hydroxyphenyl)propane, 3240 g of polyoxyethylene(2.2)-2,2-bis(4-hydroxyphenyl)propane, 1432 g of fumaric acid, 5 g of di-tert-butyl catechol, 30 g of tin(II) 2-ethylhexanoate, and 2 g of gallic acid. The components were reacted in a nitrogen atmosphere while raising the temperature from 180° to 210° C. over 5 hours, and the reaction was then carried out at 8.3 kPa for 1 hour. Subsequently, the pressure was recovered to a normal pressure, 789 g of trimellitic anhydride was then supplied thereto, and the components were reacted at a normal pressure for 1 hour, and then reacted at 8.3 kPa until a softening point reached 121° C., to provide an amorphous polyester, Resin b. The resin b had a softening point of 121° C., a glass transition temperature of 58° C., a temperature of maximum endothermic peak of 63° C., a ratio of softening point/temperature of maximum endothermic peak of 1.9, and an acid value of 20.2 mg KOH/g.

Examples 1 to 12 and Comparative Examples 1 to 9

A resin in a given amount listed in Table 2, 5.0 parts by weight of a colorant "ECB-301" commercially available from DAINICHISEIKA COLOR & CHEMICALS MFG. CO., LTD., phthalocyanine blue P. B. 15:3, 0.2 parts by weight of a negatively chargeable charge control agent "BONTRON E-304" commercially available from Orient Chemical Industries Co., Ltd., and 3 parts by weight of a releasing agent "Carnauba Wax C1" commercially available from S. Kato & CO., melting point: 88° C., were mixed with a Henschel mixer for 1 minute, and the mixture was then melt-kneaded under the following conditions.

A continuous twin open-roller type kneader "Kneadex" commercially available from MITSUI MINING COMPANY, LIMITED, outer diameter of roller: 14 cm, effective length of roller: 80 cm, was used. The operating conditions of the continuous twin open-roller type kneader are a peripheral speed of a high-rotation roller, a front roller, of 75 r/min, i.e. 32.97 m/min, a peripheral speed of a low-rotation roller, a back roller, of 50 r/min, i.e. 21.98 m/min, and a gap between the rollers at the end part of the feeding ports of the kneaded product of 0.1 mm. The temperatures of the heating medium and the cooling medium inside the rollers are as follows. The high-rotation roller had a temperature at the raw material supplying side of 135° C., and a temperature at the kneaded product discharging side of 90° C., and the low-rotation roller has a temperature at the raw material supplying side of 35° C., and a temperature at the kneaded product discharging side of 35° C. In addition, the feeding rate of the raw material mixture was 10 kg/hour, and the average residence time was about 6 minutes.

The melt-kneaded product obtained above was pressed with a cooling roller to cool it to 20° C. or lower, and the cooled melt-kneaded product was roughly pulverized to a size of 3 mm with Rotoplex, commercially available from TOA KIKAI SEISAKUSHO. Thereafter, the roughly pulverized product was pulverized with a fluidized bed-type jet mill "AFG-400" commercially available from HOSOKAWA ALPINE A.G., the pulverized product was classified with a rotor-type classifier "TTSP" commercially available from HOSOKAWA ALPINE A.G., to provide toner matrix particles having a volume-median particle size $D_{50}$ of 8.0 μm. To 100 parts by weight of the toner matrix particles were added 1.0 part by weight of a hydrophobic silica "RY50" commercially available from Nippon Aerosil Co., Ltd., average particle size: 40 nm, and 0.5 parts by weight of a hydrophobic silica "R972" commercially available from Nippon Aerosil Co., Ltd., average particle size: 16 nm while mixing with a Henschel mixer commercially available from MITSUI MINING COMPANY, LIMITED at 3000 r/min, i.e. 32 m/sec, for one minute, to provide a toner.

Incidentally, in a case where the resin J was used, a toner could not be produced.

Test Example 1

Low-Temperature Fixing Ability

Each of the toners was loaded in a nonmagnetic monocomponent developer device "OKI MICROLINE 5400" commercially available from Oki Data Corporation. With adjusting the amount of toner adhesion to 0.50 mg/cm$^2$, a solid image of 20 mm×30 mm was printed on Xerox L sheet commercially available from Fuji Xerox Co., Ltd. The solid image was taken out before passing through a fixing device, to provide an unfixed image. A sheet having the resulting unfixed image was fixed with an external fixing device, which was a fixing device taken out of "OKI MICROLINE 3010" commercially available from Oki Data Corporation, while setting the temperature of the fixing roller to 100° C. and a fixing speed to 100 mm/sec. Thereafter, the same procedures were carried out with setting the fixing roller temperature at 105° C., and raising the temperature to 200° C. in an increment of 5° C.

A plain white sheet Xerox L sheet was wound around a 1,000 g weight of which bottom had a 50 mm ϕ, and placed over a portion of the solid image fixed at each temperature and reciprocated 5 times in a width of the image portion. Thereafter, each of optical densities of the rubbed portion and the non-rubbed portion of the solid image was measured with an optical density measurement instrument "GREGSPM50" commercially available from Gretag, to obtain a percentage of lowered optical density:

[Optical density of rubbed portion/Optical density of non-rubbed portion]×100 was obtained. A temperature of a fixing roller at which the percentage of the lowered optical density initially exceeds 90% is defined as a lowest fixing temperature, and the low-temperature fixing ability was evaluated. The results are shown in Table 2.

Test Example 2

High-Temperature Offset Resistance

The images fixed at temperatures of from 100° to 200° C. obtained in Test Example 1 were visually confirmed, and a highest temperature of the fixing roller at which the generation of hot offset was not observed is defined as a highest fixing temperature. The results are shown in Table 2. In the images fixed at 200° C., in cases where the generation of hot offset was not observed were indicated as "200<."

Test Example 3

Fixable Temperature Region

A value calculated as a difference between a highest fixing temperature and a lowest fixing temperature, i.e. a highest fixing temperature—a lowest fixing temperature, obtained in Test Examples 1 and 2 is defined as a fixable temperature region. The results are shown in Table 2.

Test Example 4

Durability

Each of the toners was loaded in an ID cartridge of a nonmagnetic monocomponent developer device "OKI MICROLINE 5400" commercially available from Oki Data Corporation, and warm-up runs were conducted at 70 r/min, equivalent to 36 sheets/minute under the conditions of a temperature of 30° C. and relative humidity of 65%. The formation of uneven lines on the developer roller surface was visually observed, and a time period until which the formation of uneven lines took place was measured and used as an index for durability. The larger the numerical value, the more excellent the durability. The results are shown in Table 2.

Here, the formation of uneven lines is a state where the variance of the toner amount deposited to the developer roller is generated, and the generation of uneven line formation leads to the generation of variance in tone in the optical density upon printing.

Test Example 5

Storage Stability

A 20-ml polyethylene bottle was charged with 4 g of a toner, and allowed to stand in an open state without placing a lid of the polyethylene bottle under the environmental conditions of 50° C. and 80% RH for 48 hours. The degree of aggregation before and after allowing to stand, or storage, was measured, and the storage stability was evaluated in accordance with a ratio of the degree of aggregation after storage to the degree of aggregation before storage, i.e. the degree of aggregation after storage/the degree of aggregation before storage. The smaller this numerical value, the more excellent the storage stability. The results are shown in Table 2.

[Degree of Aggregation]

The degree of aggregation is measured with a powder tester commercially available from Hosokawa Micron Corporation.

Sieves having opening of 150 μm, 75 μm, and 45 μm are stacked on top of each other, 4 g of a toner is placed on the uppermost sieve, and the sieves are vibrated at a vibration width of 1 mm for 10 seconds. After the vibration, the degree of aggregation is calculated with an amount of the toner remaining on the sieve using the following sets of formulas:

$$\text{Degree of Aggregation} = a + b + c$$

$$a = \frac{\text{Mass of Toner Remaining on Top Sieve}}{\text{Amount of Sample}} \times 100$$

$$b = \frac{\text{Mass of Toner Remaining on Middle Sieve}}{\text{Amount of Sample}} \times 100 \times \frac{3}{5}$$

$$c = \frac{\text{Mass of Toner Remaining on Bottom Sieve}}{\text{Amount of Sample}} \times 100 \times \frac{1}{5}$$

TABLE 2

| | Crystalline Resin | | | | | | | | | |
|---|---|---|---|---|---|---|---|---|---|---|
| | Resin (Parts by Weight) | Content* of Aromatic Carblxyic Acid Compound (% by mol) | Weight-Average Molecular Weight | Amorphous Resin Resin (Parts by Weight) | Crystalline Resin/ Amorphous Resin | High-Temperature Offset Resistance | Low-Temperature Fixing Ability (° C.) | Fixable Temperature Region (° C.) | Durability (hours) | Storage Stability |
| Ex. 1 | Resin A (90) | 100 | 72,000 | Resin a (10) | 90/10 | 200< | 110 | 90< | 1.2 | 1.5 |
| Ex. 2 | Resin A (80) | 100 | 72,000 | Resin a (20) | 80/20 | 200< | 110 | 90< | 1.5 | 1.6 |
| Ex. 3 | Resin A (70) | 100 | 72,000 | Resin a (30) | 70/30 | 200< | 105 | 95< | 1.8 | 1.8 |
| Ex. 4 | Resin A (60) | 100 | 72,000 | Resin a (40) | 60/40 | 200< | 100 | 100< | 2.4 | 1.8 |
| Ex. 5 | Resin A (55) | 100 | 72,000 | Resin a (45) | 55/45 | 200< | 100 | 100< | 2.8 | 1.8 |
| Ex. 6 | Resin C (80) | 100 | 36,000 | Resin a (20) | 80/20 | 200< | 110 | 90< | 1.3 | 1.5 |
| Ex. 7 | Resin C (60) | 100 | 36,000 | Resin a (40) | 60/40 | 200< | 100 | 100< | 2.3 | 1.8 |
| Ex. 8 | Resin D (60) | 100 | 109,000 | Resin a (40) | 60/40 | 200< | 100 | 100< | 2.3 | 1.8 |
| Ex. 9 | Resin E (80) | 88 | 59,000 | Resin a (20) | 80/20 | 200< | 110 | 90< | 1.3 | 1.5 |
| Ex. 10 | Resin F (60) | 100 | 32,000 | Resin a (40) | 60/40 | 200< | 110 | 90< | 2.4 | 1.7 |
| Ex. 11 | Resin G (60) | 100 | 124,000 | Resin a (40) | 60/40 | 200< | 100 | 100< | 2.2 | 1.8 |
| Ex. 12 | Resin A (60) | 100 | 72,000 | Resin b (40) | 60/40 | 200< | 100 | 100< | 2.2 | 1.9 |
| Comp. Ex. 1 | Resin A (100) | 100 | 72,000 | — | 100/0 | 200< | 115 | 85< | 0.2 | 1.3 |
| Comp. Ex. 2 | Resin A (98) | 100 | 72,000 | Resin a (2) | 98/2 | 200< | 115 | 85< | 0.2 | 1.3 |
| Comp. Ex. 3 | Resin A (50) | 100 | 72,000 | Resin a (50) | 50/50 | 200< | 100 | 100< | 3.2 | 2.7 |
| Comp. Ex. 4 | Resin A (30) | 100 | 72,000 | Resin a (70) | 30/70 | 200< | 130 | 70< | 4.5 | 1.6 |
| Comp. Ex. 5 | Resin B (80) | 100 | 11,000 | Resin a (20) | 80/20 | 140 | 110 | 30 | 1.6 | 1.3 |
| Comp. Ex. 6 | Resin B (60) | 100 | 11,000 | Resin a (40) | 60/40 | 160 | 100 | 60 | 1.8 | 2.0 |
| Comp. Ex. 7 | Resin B (30) | 100 | 11,000 | Resin a (70) | 30/70 | 195 | 125 | 70 | 4.4 | 1.5 |
| Comp. Ex. 8 | Resin H (80) | 0 | 55,000 | Resin a (20) | 80/20 | 110 | 110 | 0 | 0.7 | 1.2 |
| Comp. Ex. 9 | Resin I (60) | 100 | 41,000 | Resin a (40) | 60/40 | 150 | 130 | 20 | 2.4 | 1.8 |

Note

*The content in the carboxylic acid component.

It can be seen from the above results that the toners of Examples 1 to 12 are excellent in all of low-temperature fixing ability, high-temperature offset resistance, fixable temperature region, durability and storage stability, as compared to the toners of Comparative Examples 1 to 9.

The toner for electrostatic image development of the present invention can be suitably used in, for example, the development or the like of latent image formed in electrophotography, an electrostatic recording method, an electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development comprising at least a resin binder, the resin binder being composed of a crystalline resin and an amorphous resin, wherein the crystalline resin comprises a crystalline polyester obtained by polycondensing an alcohol component comprising an aliphatic diol having 2 to 10 carbon atoms and a carboxylic acid component comprising an aromatic dicarboxylic acid compound and an aromatic tricarboxylic or higher polycarboxylic acid compound, wherein the crystalline polyester has a weight-average molecular weight of from 20,000 to 150,000, and wherein the crystalline resin and the amorphous resin are in a weight ratio, i.e. crystalline resin/amorphous resin, of from 55/45 to 95/5.

2. The toner for electrostatic image development according to claim 1, wherein the crystalline polyester is contained in an amount of 80% by weight or more of the crystalline resin.

3. The toner for electrostatic image development according to claim 1, wherein the aliphatic diol having 2 to 10 carbon atoms is contained in an amount of 90% by mol or more of the alcohol component of the crystalline polyester.

4. The toner for electrostatic image development according to claim 1, wherein the aromatic dicarboxylic acid compound and the aromatic tricarboxylic or higher polycarboxylic acid compound are contained in a total amount of 90% by mol or more of the carboxylic acid component of the crystalline polyester.

5. The toner for electrostatic image development according to claim 1, wherein the aromatic tricarboxylic or higher polycarboxylic acid compound is contained in an amount of from 2 to 20% by mol of the carboxylic acid component of the crystalline polyester.

6. The toner for electrostatic image development according to claim 1, wherein the aromatic dicarboxylic acid compound and the aromatic tricarboxylic or higher polycarboxylic acid compound are in a molar ratio, i.e. aromatic dicarboxylic acid compound/aromatic tricarboxylic or higher polycarboxylic acid compound, of from 98/2 to 70/30.

7. The toner for electrostatic image development according to claim 1, wherein the crystalline polyester has a weight-average molecular weight of from 35,000 to 130,000.

8. The toner for electrostatic image development according to claim 1, wherein the crystalline resin and the amorphous resin are in a weight ratio, i.e. crystalline resin/amorphous resin, of from 55/45 to 65/35.

9. The toner for electrostatic image development according to claim 1, wherein the aromatic dicarboxylic acid compound is contained in an amount of from 60 to 98% by mol of the carboxylic acid component of the crystalline polyester.

10. The toner for electrostatic image development according to claim 1, wherein the aliphatic diol having 2 to 10 carbon atoms of the alcohol component of the crystalline polyester is one or more members selected from 1,4-butanediol and 1,6-hexanediol.

11. The toner for electrostatic image development according to claim 1, wherein the aromatic dicarboxylic acid compound of the carboxylic acid component of the crystalline polyester is at least one member selected from the group consisting of phthalic acid, isophthalic acid, and terephthalic acid.

12. The toner for electrostatic image development according to claim 1, wherein the aromatic tricarboxylic or higher polycarboxylic acid compound of the carboxylic acid component of the crystalline polyester is a trimellitic acid compound.

13. The toner for electrostatic image development according to claim 1, wherein a total number of moles of the aliphatic diol having 2 to 10 carbon atoms, and the aromatic dicarboxylic acid compound and the tricarboxylic or higher polycarboxylic acid compound of a total number of moles of the carboxylic acid component and the alcohol component, which are raw material monomers for the crystalline polyester is from 75 to 100% by mol.

14. The toner for electrostatic image development according to claim 1, wherein the amorphous resin is an amorphous polyester.

15. The toner for electrostatic image development according to claim 14, wherein the amorphous polyester is a polyester obtained by polycondensing an alcohol component comprising an alkylene oxide adduct of bisphenol A represented by the following formula (I):

(I)

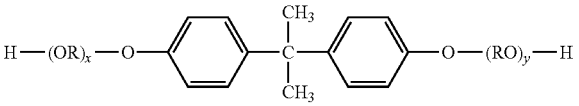

wherein each of RO and OR is an oxyalkylene group, wherein R is an ethylene group and/or a propylene group; x and y are number of moles of alkylene oxides added, each being a positive number, wherein an average of the sum of x and y is preferably from 1 to 16, and a carboxylic acid component.

16. The toner for electrostatic image development according to claim 14, wherein the amorphous polyester is contained in an amount of 90% by weight or more of the amorphous resin.

17. The toner for electrostatic image development according to claim 15, wherein the alkylene oxide adduct of bisphenol A represented by the formula (I) is contained in an amount of 70% by mol or more of the alcohol component of the amorphous polyester.

18. The toner for electrostatic image development according to claim 14, wherein the carboxylic acid component of the amorphous polyester comprises an aromatic dicarboxylic acid compound.

19. A toner for electrostatic image development comprising at least a resin binder, the resin binder being composed of a crystalline resin and an amorphous resin, wherein the crystalline resin comprises a crystalline polyester obtained by polycondensing an alcohol component comprising an aliphatic diol having 2 to 10 carbon atoms and a carboxylic acid component comprising an aromatic dicarboxylic acid compound and an aromatic tricarboxylic or higher polycarboxylic acid compound, the crystalline polyester being contained in an amount of 80% by weight or more of the crystalline resin, wherein the crystalline polyester has a weight-average molecular weight of from 35,000 to 130,000, and wherein the crystalline resin and the amorphous resin are in a weight ratio, i.e. crystalline resin/amorphous resin, of from 55/45 to 80/20, and wherein the aliphatic diol having 2 to 10 carbon atoms is contained in an amount of 90% by mol or more of the alcohol component of the crystalline polyester, and wherein the aromatic dicarboxylic acid compound and the aromatic tricarboxylic or higher polycarboxylic acid compound are contained in a total amount of 90% by mol or more of the carboxylic acid component of the crystalline polyester, and wherein the aromatic tricarboxylic or higher polycarboxylic acid compound is contained in an amount of from 2 to 20% by mol of the carboxylic acid component of the crystalline polyester, wherein the amorphous resin comprises an amorphous polyester obtained by polycondensing an alcohol component comprising an alkylene oxide adduct of bisphenol A represented by the following formula (I):

(I)

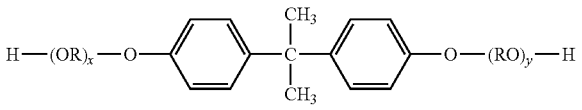

wherein each of RO and OR is an oxyalkylene group, wherein R is an ethylene group and/or a propylene group; x and y are number of moles of alkylene oxides added, each being a positive number, wherein an average of the sum of x and y is preferably from 1 to 16, and a carboxylic acid component, the amorphous polyester being contained in an amount of 90% by weight or more of the amorphous resin.

* * * * *